United States Patent [19]

Whittington et al.

[11] 4,452,010

[45] Jun. 5, 1984

[54] WINDOW SECURITY SYSTEM

[76] Inventors: Adron L. Whittington, 2710 Bristol Ave., Stockton, Calif. 95204; Willie D. Whittington, 1528 Barcelona, Stockton, Calif. 95209

[21] Appl. No.: 380,127

[22] Filed: May 20, 1982

[51] Int. Cl.[3] ..... E06B 3/68

[52] U.S. Cl. ..... 49/51; 49/64; 49/141; 49/2; 292/201

[58] Field of Search ..... 49/51, 56, 57, 62, 64, 49/67, 1, 2, 141, 394; 292/201

[56] References Cited

U.S. PATENT DOCUMENTS

| | | | |
|---|---|---|---|
| 3,455,057 | 7/1969 | Baird | 49/64 |
| 3,813,119 | 5/1974 | Panici | 292/201 X |
| 3,829,138 | 8/1974 | Morita | 49/2 X |
| 4,127,966 | 12/1978 | Schmidt | 49/394 X |
| 4,237,654 | 12/1980 | Landem et al. | 49/141 |
| 4,263,747 | 4/1981 | Coltrin et al. | 49/141 X |

*Primary Examiner*—Kenneth Downey

*Attorney, Agent, or Firm*—George F. Bethel; Patience K. Bethel

[57] ABSTRACT

The following disclosure shows a window security system. The window security system comprises a grate or security bar assembly that is hinged to the outside of a window and includes louvres attached to the grate for protecting against the elements and in particular, sunlight. The grate is hinged to the window at one side, while on the other side, it is secured by means of a latch comprising a pointed latch pin which is engaged by a pair of jaws that are pivotally actuated by a toggle member. The toggle member can be actuated by a solenoid or by a hand operated cable or other assembly attached thereto. The solenoid can be either pushbutton operated or operated by means of a smoke detector. The entire assembly, including the grate and the louvres are opened at the time of the smoke detector detecting combustion to protect against entrapping occupants in the building.

6 Claims, 5 Drawing Figures

WINDOW SECURITY SYSTEM

BACKGROUND OF THE INVENTION

1. Field of the Invention

The field of this invention lies within the construction field. More particularly, it lies within the field of providing securement to structures in window spaces and other areas. The security is provided by a grating which is pivotally hinged and is known in the prior art in the form of protective grates which swing back and forth on a window fixture in order to prevent unwarranted entrance and intrusion by outsiders into the building to which the security grate is connected.

2. The Prior Art

The prior art with regard to window gratings involves a number of various prior art devices for decorative as well as protective window grates.

Some of the prior art window grates are of a Spanish design wherein wrought iron has been configured to a decorative wrought iron look. The wrought iron grates are hinged to a structure, and are generally locked with a padlock from the inside.

Other types of gratings and structures have been used for industrial buildings and warehouses, as well as commercial establishments. These grates generally are pivoted or are on a sliding track. One way or the other, the grates are formed whereby they cover a window or door space and are locked in place by means of a suitable locking device, such as a padlock.

The prior art also incorporated window louvres and shutters to keep out the elements and the sunlight. In such cases, the louvres were generally attached to the frame. The interior frame louvres operated on a track on the inside of the frame. The outside louvres oftentimes operated on a pinion and crank type of arrangement in order to pivot the louvres into an open or closed position, depending upon the particular location as desired.

In addition to the foregoing general prior art with respect to the security device disclosed herein, there have been certain patents pertaining thereto. In particular, U.S. Pat. No. 4,237,654, issued to Landem in December of 1980, shows a window that is actuated and opened by means of a latch. The window frame is pivotally actuated so that it is pivoted outwardly after it has been released.

The release constitutes electrical actuation of a latch attached to the window frame. The latch is held by means of a spring biased pin that is pulled down by means of a solenoid upon actuation. More particularly, the patent discloses the fact that electrical latching systems therein can be actuated by a smoke or other combustion products detection unit, and a switch contact.

There are other types of systems that incorporate solenoid operated opening means but not necessarily for grates and security grates having louvres in connection therewith.

This invention is directed toward the concept of having a substantial improvement over the prior art by virtue of incorporating a security grate that is operable for opening the grate during emergency situations. As can be appreciated, the grates are usually locked in place to protect entrance and intruders from the outside. During an emergency, whether it be fire, or other emergencies, the occupants are sometimes trapped without being able to exit through the grates. There has been substantial loss of life in certain situations wherein occupants have not been able to pass through the grates and are trapped in the room during emergencies.

This invention incorporates the concept of having a manually operable inside latch that can open the grate. The manually operated latch incorporates a sure and facile toggle element that releases a spring loaded latch pin, so that the grate opens upon actuation thereof.

The spring loaded latch pin can also be actuated by means of the toggle being opened by means of a smoke detector. The smoke detector can be used to detect any type of smoke or combustion in order to issue a signal to an opening means. In particular, the opening means can be in the form of a solenoid that actuates the toggle to open up the jaws of the latch to release the latch pin of this invention.

In addition to the foregoing features, this invention incorporates louvres which can be oriented for protection against the elements, such as sunlight. The louvres are particularly adaptable and usable with regard to the grate of this invention. This obviates the sole utilitarian function of prior art grates to allow them to do more than merely prevent incursions into the building. In particular, the grate also serves the function of providing aesthetic closures and protects against sunlight and viewing from the outside.

As a consequence of the foregoing, this invention has novel features over the prior art which will become apparent in the specification set forth hereinafter. In particular, it will be seen that this invention is a substantial step over the prior art incorporating mere grates, whether they be decorative or security grates. Also, it enhances the prior art grates by utilizing a plurality of louvres to protect against outside viewing and sunlight. In addition thereto, the grate is actuated either manually or by a smoke detector in order to provide an opening thereof during emergency conditions, so that the occupants of a building in which the grate is attached, will not be trapped within the building. As a consequence, this invention is a substantial step over the prior art as will be seen hereinafter as summarized, specified, and claimed.

SUMMARY OF THE INVENTION

In summation, this invention comprises a grate or protective series of bars that are hinged to a window. The grate incorporates louvres and means for opening the grate from a secure position to an open position that can be manually or automatically actuated by a remote control such as a smoke detector when smoke is detected.

More particularly, the invention incorporates a metal grid. The grid can be in the form of a grate or other metal security closure that is hinged or slidably operated over a window. The grate or grid is provided with louvres which can be angularly oriented with regard to the sunlight. In this manner, the angularly oriented louvres can protect the interior of the building to which the grate is attached from sunlight and provide a closure to prevent unwarranted viewing therethrough.

The entire grate is pivotally hinged on one portion of a window frame and connected by means of a latch at the other portion. The latch incorporates a latch pin. The latch pin is secured by means of actuatable jaws which close over the pin to secure the grate in its closed position.

When the jaws open, a spring loading permits the grate to be moved outwardly on its pivotal connection.

This thereby allows exit by occupants who have been trapped in the building.

The opening of the jaws can be provided by a toggle assembly which opens and closes the jaws by means of the toggle assembly being moved by a linkage. The linkage can be in the form of a manually operable cable, or a linkage attached to an electro-mechanical means.

The electro-mechanical means can be a solenoid for purposes of driving the toggle. The solenoid in turn can be actuated by means of electrical contacts that are closed or a signal provided by a switch.

Also, and of substantial importance is the fact that the toggle when operated by the solenoid can be actuated by a smoke detector. The smoke detector in effect can be utilized to detect when smoke is encountered within the building. It can then send a signal to the solenoid to operate the toggle for opening the jaws for purposes of releasing the grate, thereby allowing the occupants to exit the building to which the grate is attached.

As will be seen from the following specification, the invention substantially incorporates the foregoing features as a combination unit for a substantial improvement over the state of the art.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 2:
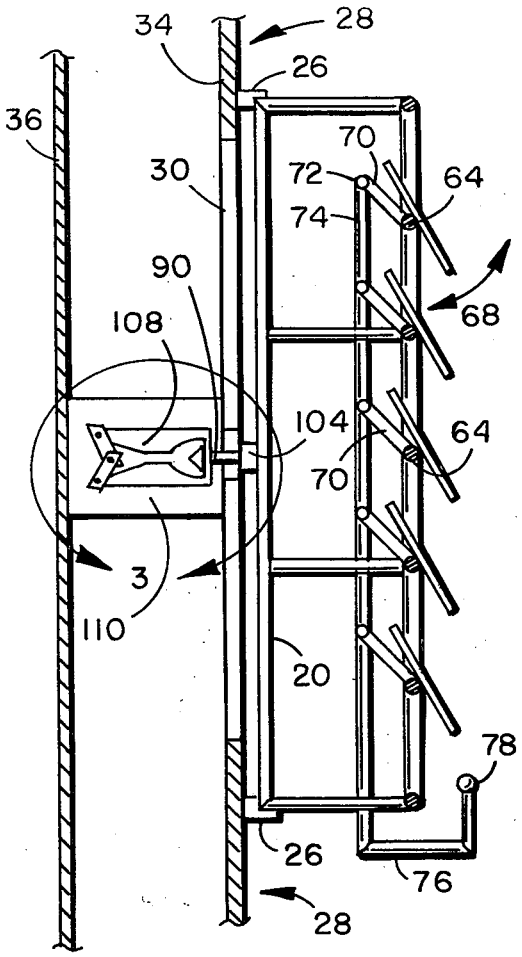
FIG. 2 shows a side elevation view as sectioned through the wall and specifically shows the outside grate and louvres in conjunction with the locking device and latch pin of the invention.
Figure 1:
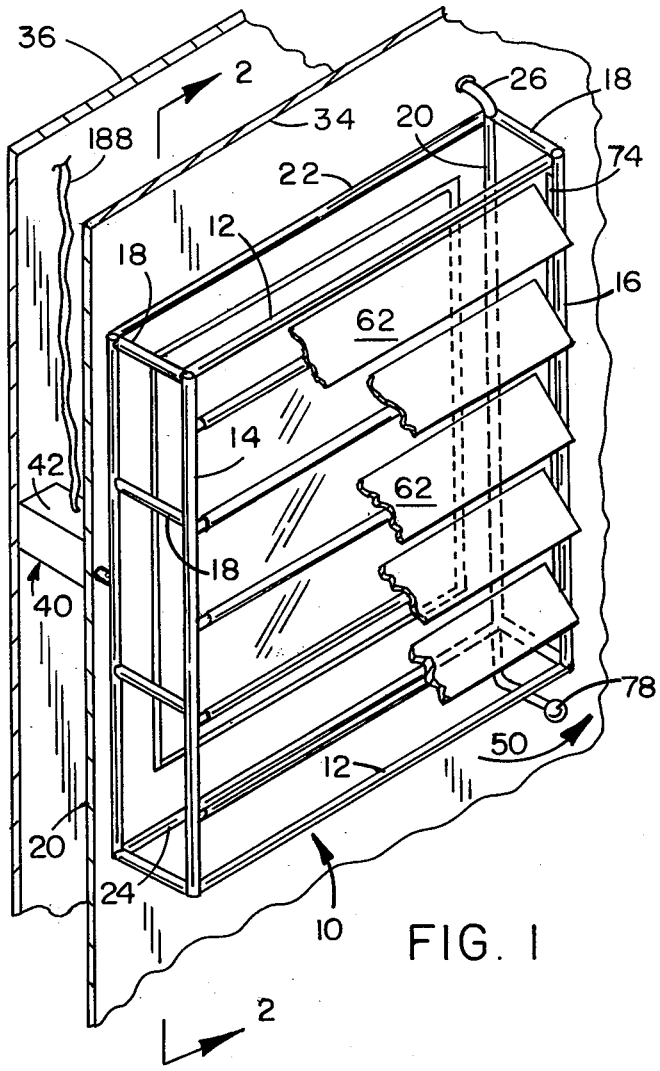
FIG. 1 shows a perspective view of the security system of this invention that has been fragmented in part along the louvres and has been broken away to show the interior of the wall to which the security system is attached.

Looking particularly at FIG. 1, it can be seen that a grate 10 has been shown comprising horizontal front bars 12 extending from the bottom to the top. The horizontal front bars 12 are supported by vertical support bars 14 and 16 on either side which are in turn attached to extension bars 18 that extend from a set of rear bars 20 attached to horizontal cross bars 22 and 24.

The grate 10 can comprise any type of bars which are oriented in a decorative manner. The bars that have been oriented in a decorative manner can be attached by any suitable means to a hinge 26 which is attached to a wall 28 of a structure. The wall 28 encloses a window 30. The wall 28 has an outer wall portion 34 and an inner wall portion 36. The inner wall portion 36 and the outer wall portion 34 have a space therein which is known in most types of construction.

The respective inner and outer wall portions 34 and 36 house an actuator or catch means 40 that is shown within a box-like housing 42.

The grid or grate 10 when supported on its hinges 26 pivots outwardly in the direction of arrow 50 and swings so that it clears the window space 30. When it swings in the direction of arrow 50, it allows any occupants within the structure surrounded by the wall 28 to leave the window.

The grate 10 can be configured in any suitable configuration, such as a decorative wrought iron, Spanish or other type of grate or grillwork in order to protect the building from outsiders.

In order to enhance the grate or grillwork, a number of louvres 62 are shown. The louvres 62 are plural in number and are attached to pins 64 so that they can pivot around the axis of the pins 64. Each of the pins 64 is attached to the louvre and drives them at an angle inwardly and outwardly respectively in the direction of arrow 68.

The pins to which the louvres 62 are attached, are connected to linkage bars 70 which are in turn pivotally connected by pins 72 to a main linkage bar 74. The main linkage bar 74 connects to a lower crank arm or lever 76 to which a handle 78 is attached. The linkage bar can be in any suitable form and the handle 78 can be substituted by any suitable drive means. The essence of the invention is to allow the louvres 62 to angularly orient themselves with respect to the window to open or close the amount of light being admitted into the window 30.

In addition to the foregoing, the linkage bar 74 attached to the linking member 70 can be connected interiorly to the inside of the building through wall 28 for operation internally of the building.

In addition to the foregoing hand operated lever 78, the louvres 62 can be operated by the classical means of having the linkage 74 operate upwardly and downwardly by means of a rotational crank arm. In this form, the crank attaches to a pinion gear which turns a rotational drive rod, which in turn cranks the linkage 74 upwardly and downwardly to orient the louvres 62 in whatever angular direction is desired.

Figure 3:
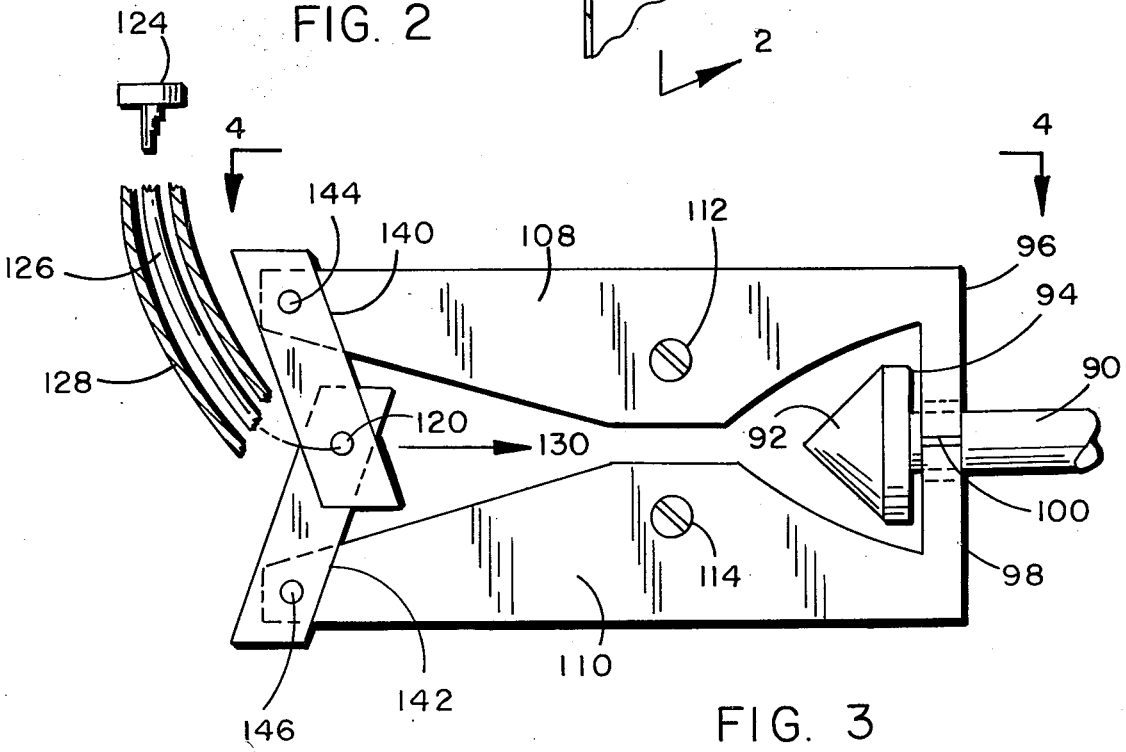
FIG. 3 shows an enlarged view of the toggle and latch pin for securing the security grate.
Figure 4:
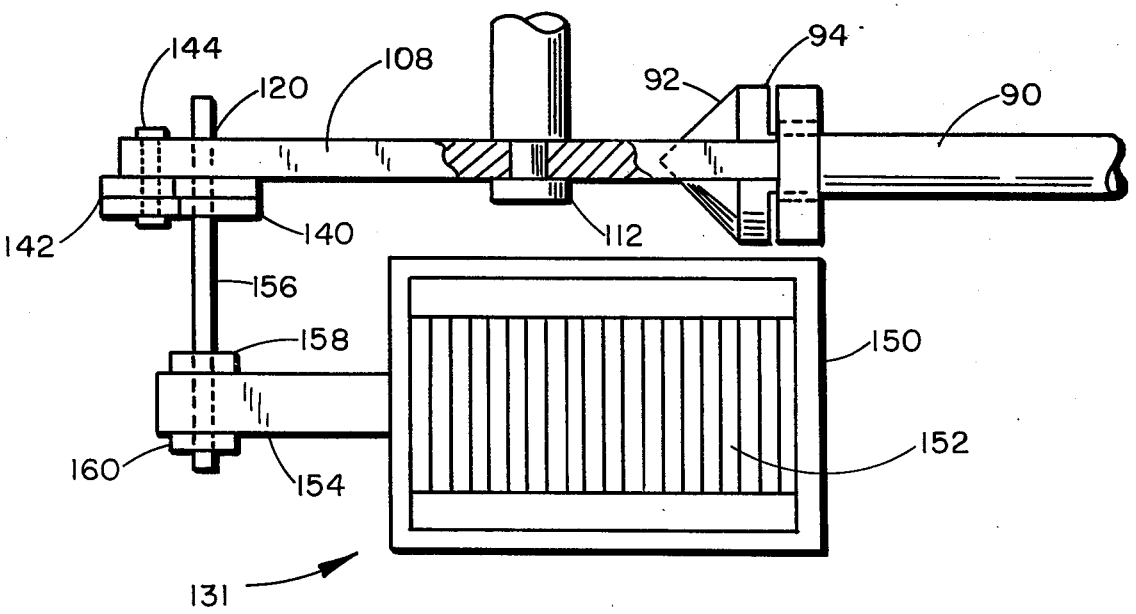
FIG. 4 shows a top plan view looking downwardly on the toggle and actuator that would be seen looking downwardly on the elements of FIG. 3 along lines 4—4 thereof within the box shown in FIG. 1 in which the actuator is housed; and, FIG. 5 shows a schematic block diagram of the invention incorporating the smoke detector and the various means for operating the invention.

Looking more particularly at the enclosure 40 which houses a latch pin, it can be seen that the latch pin enclosure device is more specifically detailed in FIGS. 3 and 4.

The latch pin is shown as a latch pin 90 having a pointed end 92. The pointed end is formed as a conical member having a base 94. The pin 90 with the base 94 engages jaws 96 and 98. The jaws 96 and 98 open along a parting line 100 to release the base 94 of the latch pin 90.

The conical portion of the latch pin with the pointed end serves to penetrate the gap 100 when it is rammed therethrough. The angular element of the pointed end 92 penetrates the jaws 96 and 98 of the latch pin when the grate 10 is closed. As can be seen, the grate 10 is attached by the vertical frame member 20 to the latch pin 90 and enlarged portion 104 which is welded to the frame 20.

The jaws 96 and 98 are a part of two pivotal members or arms 108 and 110 which are pivoted on pivot points provided by screw members or pins passing therethrough, namely screw members 112 and 114. Thus, the space 100 can be opened so as to provide entrance and exit of the latch pin end 92 when it is passed thereinto.

The pivotal arm members 108 and 110 for purposes of pivoting on points 112 and 114 can be driven by a cable linkage that can be attached to a pivotal connection point 120 formed by a pin passing therethrough. The cable is shown in a fragmented form in this optional embodiment and would normally be attached to pin 120 by means of a handle 124.

The cable is shown as a cable 126 sheathed within a tubular carrying sheath 128. Accordingly, when the button or handle 124 is depressed, it can drive the pin 120 in the direction of arrow 130 which thereby causes the jaws 96 and 98 to open by the pivotal action when they pivot on points 112 and 114.

The pivotal action when the pin 120 is driven in the direction of arrow 130 is such that it draws members 140 and 142 inwardly which are connected to pins 144 and 146. These respective pins 144 and 146 allow for a downward movement by the toggle relationship of the members 140 and 142 pulling the respective ends of the pins 144 and 146 downwardly to open the jaws 96 and 98.

The pin 120 can also be driven in the direction of arrow 130 by a solenoid 150 which has been shown as a series of coils 152 providing movement to a plunger 154. The plunger 154 is connected to a linkage rod 156 which is held in place by means of two sleeves 158 and 160 which can be nuts or other suitable means for holding the rod 156 to the plunger 154.

The solenoid 150 can be driven by means of any kind of signal which will cause it to activate and pull the plunger 154 in the direction of arrow 131, which is the analogous direction to arrow 130. Upon pulling the rod 156 in the direction of arrow 130, the toggle members 140 and 142 are activated by the pin 120 being moved in the direction of arrow 130. This, in turn, causes the toggle members 140 and 142 to activate the jaws 108 and 110 so as to cause the latch pin 90 to be released.

The entire device can be driven by any suitable power source. The solenoid coils 152 can be energized by means of the power source being interconnected through a switch means or a smoke detector creating a signal. This has been shown in the schematic view of FIG. 5 which shall be detailed hereinafter as an alternative embodiment.

One way or the other, the coils 152 must be energized in order to create the movement of the rod 156 to move the pin 120 in the direction of arrow 130.

The manual release is shown in the form of the cable 126 connected to the latch and solenoid assembly at point 120. However, it can be in any other suitable form so long as it allows the release of the latch pin 90 in a manner whereby the grating or grillwork 10 will open.

Figure 5:
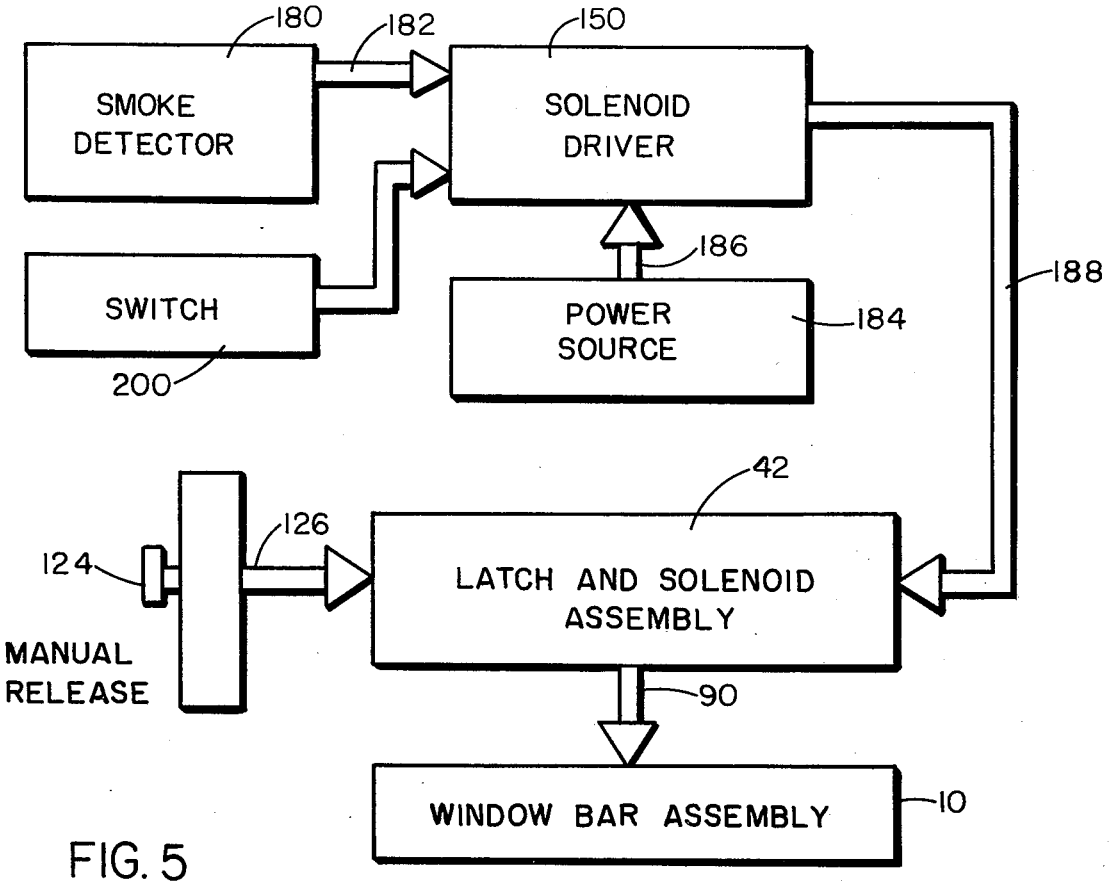

Looking more particularly at the showing of FIG. 5, it can be seen wherein a smoke detector 180 is shown connected to the solenoid driver 150 by means of a connection 182. The connection 182 can be through any cable or other suitable electrical connection. The smoke detector can be implaced in a ceiling area or other suitable area to detect smoke and then provide a signal along a conductor, such as connector 182.

When the signal is received, it actuates the solenoid driver 150 that is connected to a power source 184. The solenoid driver 150 can be in effect a relay or other suitable means for allowing the power source 186 to be delivered to the latch and solenoid assembly 42 within the housing 40. The connection can be along a conductor 188 that has been connected to the latch and solenoid assembly 42.

The latch and solenoid assembly in its entirety is seen in FIGS. 3 and 4 as to the elements which include the solenoid and the latch. These respective elements drive the latch pin which is shown as the latch pin 90 interconnecting the latch and solenoid assembly to the window bar assembly or grate 10.

The solenoid driver can be of any particular type that can receive a signal from a smoke detector or for that matter, a switch 200 which has been shown as a button type switch to activate the solenoid driver to allow for the delivery of power to the solenoid for actuating the coils 152.

From the foregoing disclosure, it can be seen that the solenoid driver, latch and solenoid assembly, operate the window bar or grate to provide for a facile and readily operable security system when smoke is detected. The system can also operate when a manual release is actuated, such as the release button 124 on the cable 126, as well as an electric switch connected to the solenoid driver, such as switch 200.

The operation of the invention is in a mode whereby when it is connected to the smoke detector, the smoke detector detects smoke and puts out a signal on line 182. After the signal is put out on line 182, it causes the solenoid driver to apply power to the solenoid assembly.

The solenoid assembly then serves to operate the latch pin by releasing it from the jaws 96 and 98. The jaws can be of a variable configuration having various types of spring loaded configurations. In some cases, the jaws can be utilized with and without a spring bias. Regardless of the foregoing, to enable the gridwork 10 to open up, a spring bias can be used in the form of a spring driving the latch pin 90 or the spring can be utilized to drive the grate 10 itself.

In addition to the foregoing, a coil spring can be used to push the latch pin 90 by being biased against the surface 92 and latch pin 90.

Upon actuation, the grate swings open. In the eventuality other emergencies occur, the electrical switch 200 can be used to actuate the jaws 96 and 98 to open the grate. In the eventuality of power failure, the manual release 124 can be utilized to drive open the grate 10 for exit of the occupants through the window 30 to the outside.

As can be seen, the overall invention incorporates the various means of opening the grate 10 as well as the louvres 62 and the smoke detector which drives the grate into the open configuration. Regardless of the foregoing, it will be seen that the invention has significant merit over the prior art and it should be read broadly in light of the following claims.

We claim:

1. An improved grate and latching combination for providing security to a building wherein the improvement comprises:

a pivotal grate attached to the side of a building;

a latch pin connected to said grate formed by a pin having an enlarged head with a reduced end;

jaw means for securing said enlarged head of said latch pin which open and close around said enlarged head of said latch pin on a pivotal basis and which are supported by two pivot points wherein each jaw forms an elongated member pivoted on said pivot points;

toggle means attached to said pivotal jaws formed by two members that are pivotally connected on said pivotal jaws and wherein said toggle members are connected by means of a pin so that as said pin is moved with respect to said jaws, it causes said pivotal members to pivot upwardly and downwardly, thereby opening and closing said jaws;

electrical drive means formed as a solenoid attached to said pin that is connected to said toggle;

a solenoid driver connected to a power source for providing power to said solenoid when said solenoid driver is actuated; and, a smoke detector connected to said solenoid driver for providing a signal to said driver for opening and closing said jaws when smoke is detected by causing said solenoid driver to cause said solenoid to open and close said jaws.

2. The combination as claimed in claim 1 further comprising:

a manual release means connected to said toggle for causing it to move with respect to said jaws for opening said grate.

3. The combination as claimed in claim 2 wherein said manual release is formed as a handle attached to a cable having a drive member connected to said pin of said toggle.

4. The combination as claimed in claim 3 further comprising:

switch means for operating said solenoid driver to provide power to said solenoid, thereby causing said toggle member to open said jaws.

5. The combination as claimed in claim 4 further comprising:

louvres attached to said grate for blocking sunlight from entering the grate and into the building to which said grate is attached.

6. The combination as claimed in claim 5 further comprising:

linkage means for said louvres to open and close said louvres by means of said linkage.

* * * * *